US006244893B1

(12) United States Patent
Dudley et al.

(10) Patent No.: US 6,244,893 B1
(45) Date of Patent: Jun. 12, 2001

(54) STRANDED WIRE ELECTRICAL CONNECTOR

(76) Inventors: Charles Dudley, 630 Cardinal Dr., Harrisburg, PA (US) 17111; Gúnter Feldmeier, Lindenstrasse 18c 64653, Lorsch (DE); Heinz Scherer, Bachgasse 29a 64625, Bensheim (DE); Stefan Hein, Carl-Benz Strasse 10/1 69514, Laudenbach (DE)

( * ) Notice: Subject to any disclaimer, the term of this patent is extended or adjusted under 35 U.S.C. 154(b) by 0 days.

(21) Appl. No.: 09/182,683

(22) Filed: Oct. 30, 1998

(51) Int. Cl.[7] ..... H01R 4/24

(52) U.S. Cl. ..... 439/427; 439/460; 439/656; 439/790

(58) Field of Search ..... 439/427, 790, 439/791, 460, 656, 657, 583, 584, 585, 409, 417, 465

(56) References Cited

U.S. PATENT DOCUMENTS

| | | | | |
|---|---|---|---|---|
| 3,411,129 | * | 11/1968 | Peters | 439/427 |
| 3,517,112 | | 6/1970 | Wahl | 174/75 |
| 3,820,059 | * | 6/1974 | Gibbons | 439/427 |
| 3,951,503 | | 4/1976 | Caulkins | 339/100 |
| 4,091,233 | | 5/1978 | Berman | 174/88 R |
| 4,139,727 | * | 2/1979 | Kuballa | 439/465 |
| 4,971,564 | | 11/1990 | Meyer | 439/70 |
| 5,057,650 | * | 10/1991 | Urushibata et al. | 439/465 |
| 5,085,594 | | 2/1992 | Kaelin | 439/427 |
| 5,318,458 | | 6/1994 | Thorner | 439/427 |
| 5,439,388 | * | 8/1995 | Weiss et al. | 439/417 |
| 5,453,024 | * | 9/1995 | Patinier | 439/410 |
| 5,503,568 | | 4/1996 | Pryce | 439/427 |
| 5,681,179 | | 10/1997 | Lane | 439/393 |
| 5,704,801 | * | 1/1998 | Walker et al. | 439/417 |
| 5,725,390 | * | 3/1998 | Watts | 439/410 |
| 5,733,139 | * | 3/1998 | Bray et al. | 439/402 |
| 5,735,706 | * | 4/1998 | Ito | 439/402 |
| 5,755,589 | * | 5/1998 | Koch | 439/427 |
| 5,846,098 | * | 12/1998 | Shiga et al. | 439/409 |
| 5,899,769 | * | 5/1999 | Konetschny et al. | 439/427 |
| 5,911,604 | * | 6/1999 | Chadbourne | 439/790 |
| 5,934,937 | * | 8/1999 | McCarthy | 439/427 |
| 5,959,394 | * | 9/1999 | Lin | 439/417 |
| 6,012,955 | * | 1/2000 | Shinchi | 439/874 |
| 6,019,628 | * | 2/2000 | Shinchi | 439/465 |

* cited by examiner

*Primary Examiner*—Tho D. Ta

(57) ABSTRACT

A connector for establishing an electrical connection with a wire includes a retention member and a contact pin. The retention member has a first surface and a second surface adapted to retain the wire therebetween. At least a portion of the contact pin is insertable into the wire. A method for establishing an electrical connection with a wire includes retaining the wire and inserting a contact pin into the wire.

27 Claims, 9 Drawing Sheets

STRANDED WIRE ELECTRICAL CONNECTOR

BACKGROUND OF THE INVENTION

1. Field of the Invention

This invention relates generally to electrical connectors, and more particularly, to an electrical connector for use with a stranded wire.

2. Description of the Related Art

Electrical connectors have been developed for connecting wires to a variety of devices. It is generally desirable to have a quick, effective means for connecting wires to a variety of electrical devices without having to strip the insulation from the wire prior to termination.

An insulation displacement contacts (IDC) type connector is one type of electrical connector that obviates the need to pre-strip the insulation. In an IDC connector, an insulated wire is forced into a grove in the connector. The groove cuts through the insulation and contacts the underlying conductor, thus establishing an electrical connection. IDC connectors are best suited for use with wires having solid core conductors.

Stranded conductor wires, on the other hand, are not effectively terminated using an IDC connector. The individual strands may be cut or broken during the insertion process. The use of small gauge wires with high strand counts exacerbates the problem.

Another shortcoming of IDC connectors is that they are not reusable. If a wire is removed from an IDC connector, the portion previously terminated in the IDC connector must be removed before the wire can be re-terminated.

Most conductive materials, over time, develop oxide layers, film layers, or the like that degrade their ability to contact another conductor to maintain an electrical connection. It has been found that if two conductors are constantly forced together with some amount of residual force, the electrical connection between the two conductors is enhanced. For example, cantilevered contacts are typically spring loaded contacts that are held in contact with interfacing strip contacts by a compressive spring force. The spring nature of the cantilever contact provides the residual force between the two contacts necessary to maintain an effective electrical connection. In an IDC connector, the conductor of the wire is forced into an interference fit with the IDC connector.

The present invention is directed to overcoming, or at least reducing the effects of, one or more of the problems set forth above.

SUMMARY OF THE INVENTION

In one aspect of the present invention, a connector is provided for establishing an electrical connection with a wire. The connector includes a retention member and a contact pin. The retention member has a first surface and a second surface adapted to retain the wire therebetween. At least a portion of the contact pin is insertable into the wire.

In another aspect of the present invention, a method is provided for establishing an electrical connection with a wire. The method includes retaining the wire and inserting a contact pin into the wire.

BRIEF DESCRIPTION OF THE DRAWINGS

Other objects and advantages of the invention will become apparent upon reading the following detailed description and upon reference to the drawings in which.

Figure 1:
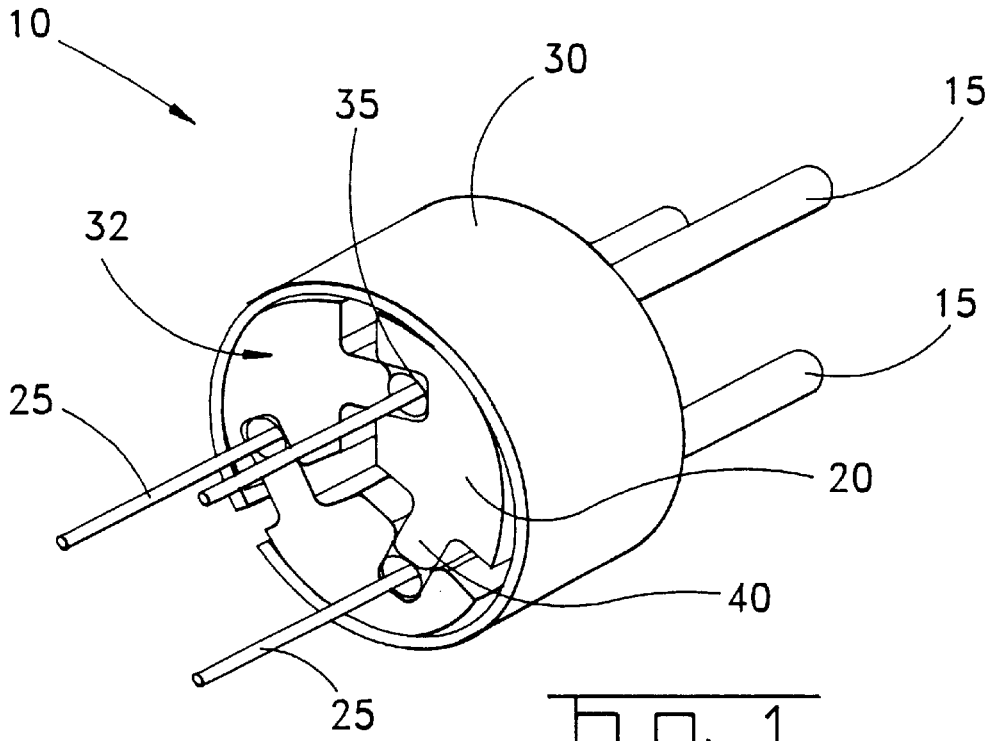
FIG. 1 is an isometric view of an electrical connector in accordance with the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Referring now to the Figures, and in particular to FIG. 1, an isometric view of an electrical connector 10 in accordance with the present invention is provided. The connector 10 is adapted to interface with a plurality of electrical wires 15. The connector 10 includes a plurality of spacers 20 for retaining and separating the wires 15, a plurality of contact pins 25 for establishing an electrical connection with the wires 15, and a compression member 30 for providing a compressive force on the spacers 20 to maintain the alignment of the wires 15. Collectively, the spacers 20 form a retention member 32 for retaining the wires 15. The spacers 20 could be made out of a variety of different materials, such as different dielectric materials. In one embodiment, the spacers 20 would be made from a transparent material, such as polycarbonate, to allow the operator to see when the wires 15 are properly installed.

In the illustrated embodiment of FIG. 1, the spacers 20 cooperate to provide the connector 10 with a circular cross-section. Each spacer 20 includes a channel 35 and a tab 40 defined therein. The tab 40 of one spacer 20 cooperates with the channel 35 of an adjacent spacer 20 to retain the wire 15 in the channel 35. The compression member 30, which in the illustrative embodiment is a metal spring or sleeve, provides a compressive force that forces the tab 40 into the channel 35. Other materials can be used for the compression member 30, as long as the material provides an elastic compressive force. The compressive force provided by the compression member 30 may also deform the cross-section of the wire 15 from its original circular shape. In the illustrative embodiment, the tab 40 extends further than the depth of the channel 35 to ensure that the force provided by the compression member 30 is transferred to the wire 15. The force, when transferred from spacer to spacer, goes only through the wire and not directly from spacer to spacer by physical contact.

As can be readily appreciated by one of ordinary skill in the art, the connector 10 of FIG. 1 may be modified to accommodate any number of wires 15. The connector 10 has a circular cross-section and the spacers 20 may be used to collectively define the circle. For the three-wire connector 10, each spacer 20 covers a sector of about 120°. To accommodate two wires 15, each spacer 20 would cover a sector of about 180°. Consequently, to accommodate N wires 15, each spacer 20 would cover a sector of about 360°/N. For a single wire connector 10, one spacer 20 could have only the channel 35 defined therein, and another spacer 20 could have only the tab 40.

The contact pins 25 are inserted axially into the wires 15. In the illustrated embodiment, the wires 15 are stranded wires, the invention can be used on a wider variety of stranded wires, with varying strand count. The contact pins 25, while being inserted, displace the strands of the wire 15. After being inserted, the contact pins 25 are embedded in the conductive strands of the wire 15, thus establishing an electrical connection without requiring the insulation of the wire 15 to be stripped. The compression member 30 provides residual compressive force to the wires 15 through the spacers 20 to maintain the electrical connection between the wire 15 and the contact pin 25. Any movement of the contact pin 25 within the strands of the wire 15 will not decrease the effectiveness of the connection because the residual force will serve to keep the contact pin 25 in contact with the wire 15.

The connector 10 is capable of being used repeatedly, without requiring reconditioning (e.g., cutting off the ends) of the wires 15. The contact pins 25 may be retracted and reinserted from the wires 15 without significantly damaging or disrupting the integrity of the wires 15.

Figure 2:
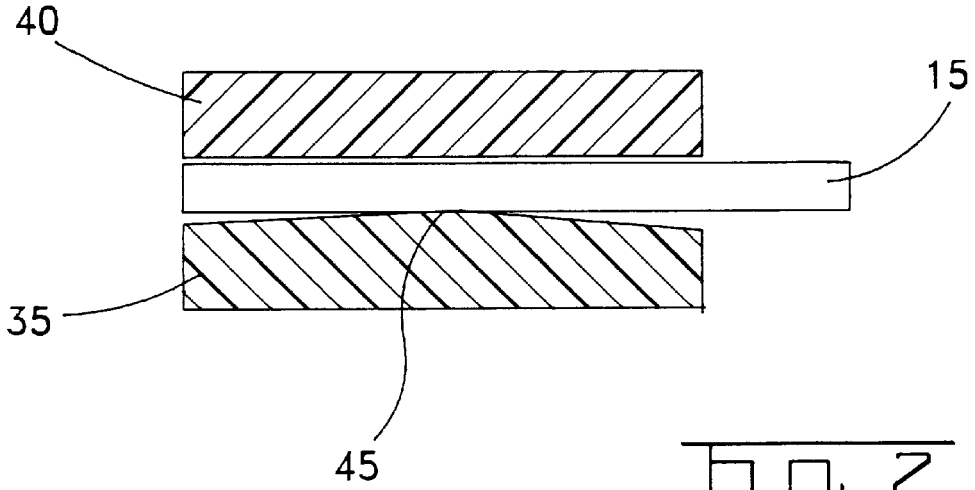
FIG. 2 is a longitudinal cross-sectional view of a channel defined in the retention member of FIG. 1.

FIG. 2 illustrates a longitudinal cross-section of the channel 35 defined in the spacer 20. The channel 35 has a raised portion 45. In the illustrated embodiment, the raised portion 45 is located near the center of the channel to concentrate the compressive force provided by the compression member 30 in the middle of the connector 10. It is contemplated that the channels 35 may include more than one raised portions 45 or no raised portions 45, depending on the specific application. The raised portion 45 is shown near the center of the channel, but the raised portion may also be near the end of the channel. It is also contemplated that the wire 15 may be retained using a feature other than a channel 35. For example, the wire 15 could be held between two cooperating surfaces, such as plates.

Figure 3A:
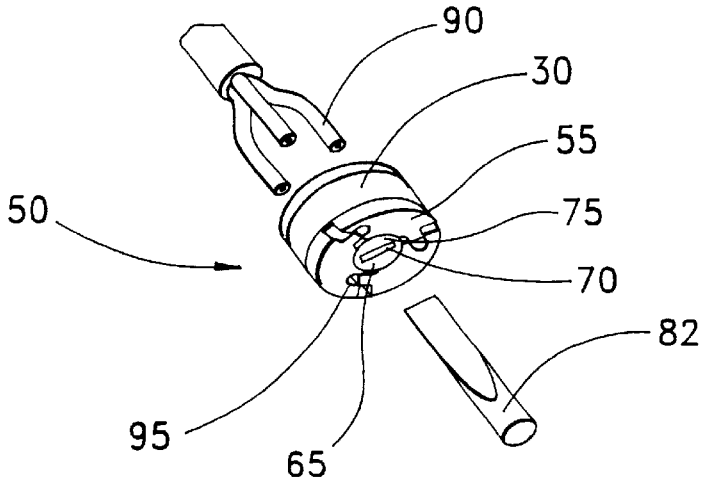
FIG. 3A is an isometric view of an alternative electrical connector in accordance with the present invention in an expanded position.
Figure 3B:
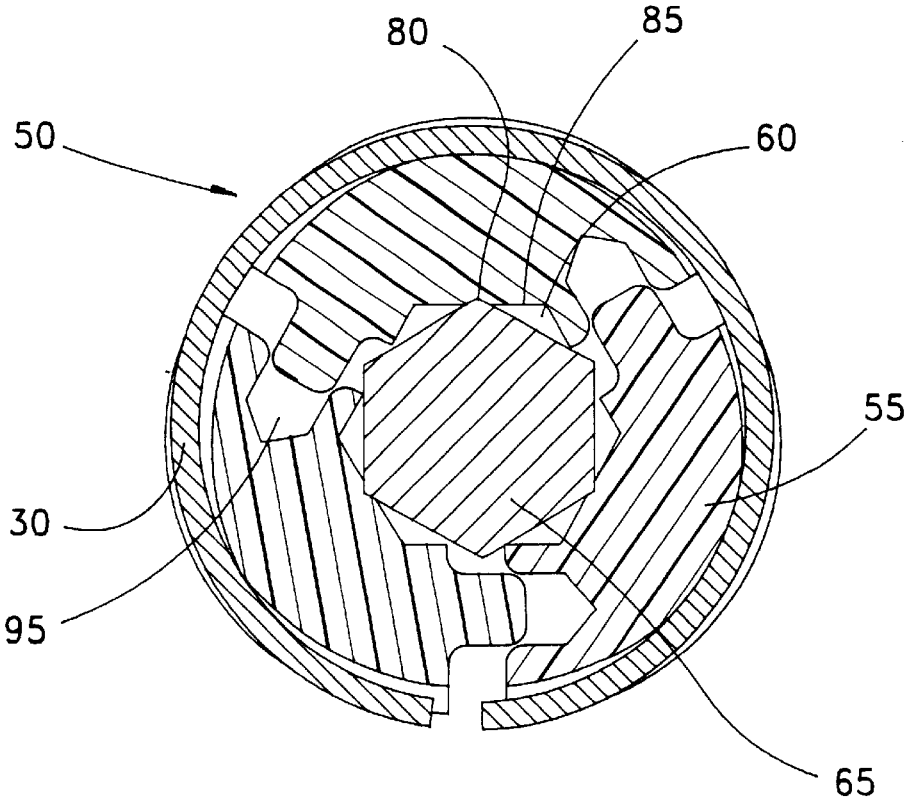
FIG. 3B is a cross-sectional view of the connector of FIG. 3A.

Turning to FIGS. 3A and 3B, an alternative embodiment of an electrical connector 50 is provided. FIG. 3A illustrates an isometric view of the connector 50, and FIG. 3B illustrates a cross-section of the connector 50. The electrical connector 50 includes spacers 55 that when interfaced define a bore 60 through the center of the connector 50. A cam device 65 is disposed within the bore 60. Rotational movement of the cam device 65 urges the spacers 55 away from one another. In the illustrated embodiment, the bore 60 has a hexagonal cross-section, and the cam device 65 has a shape similar to that of an extended hexagonal bolt head. Other polygonal bore 60 cross-sections are contemplated. The cam device 65 includes a slot 70 defined in its top surface 75 for facilitating rotation of the cam device 65 with a tool 82 (e.g., a screwdriver). The cam device 65 also has a hexagonal cross-section corresponding to that of the bore 60. FIG. 3B illustrates the cam device 65 in an expanded position. The corners 80 of the cam device 65 contact the faces 85 of the bore 60 as the cam device 65 is rotated, thus forcing the spacers 55 away from one another. In this expanded position, the wires 90 may be inserted into the channels 95 of the spacers 55.

Figure 4A:
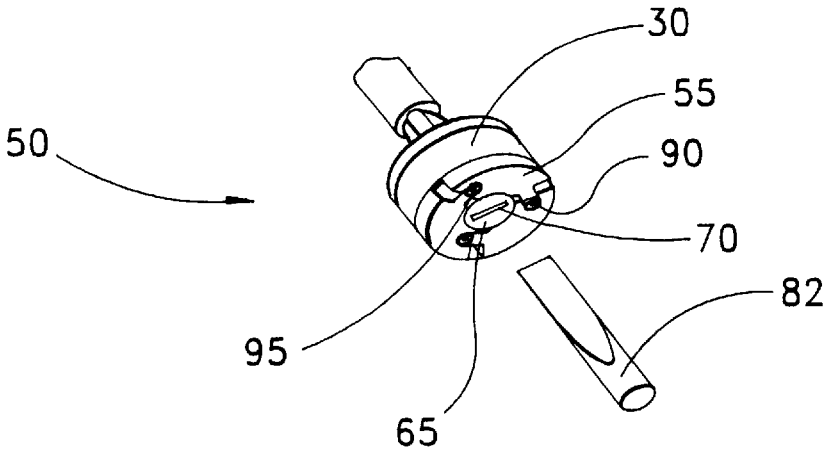
FIG. 4A is an isometric view of the connector of FIG. 3A in an engaged position.
Figure 4B:
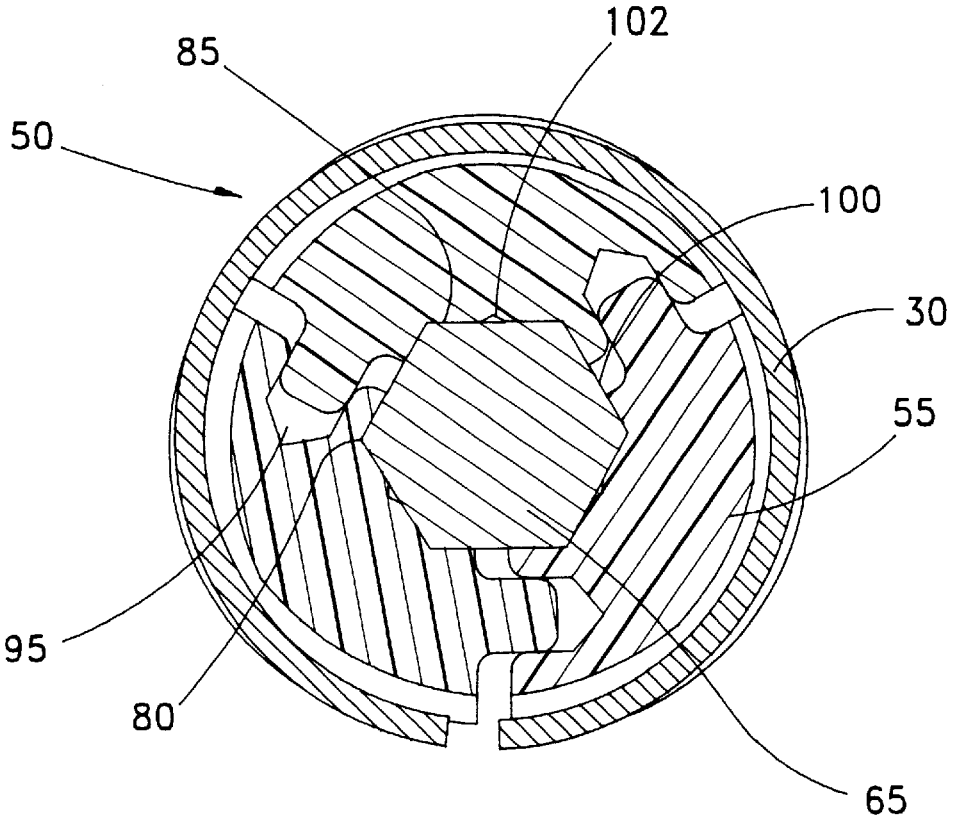
FIG. 4B is a cross-sectional view of the connector of FIG. 4A.

FIGS. 4A and 4B illustrate the connector 50 in an engaged position. FIG. 4A illustrates an isometric view of the connector 50 engaged with the wires 90, and FIG. 4B illustrates a cross-section of the connector 50 in the engaged position. The wires 90 have been omitted from FIG. 4B for clarity and ease of illustration. In the engaged position, the faces 100 of the cam device 65 are aligned with the corresponding faces 85 of the bore 60, thereby allowing the compression member 30 to provide compressive force to the spacers 55, causing the spacers 55 to engage and retain engage the wires 90. The diameter of the bore 60 is larger than the diameter of the cam device 65 to prevent the cam device 65 from absorbing the compressive force applied to the spacers 55 by the compression member 30. Notches 102 are defined in the faces 85 of the bore 60 to engage the corners 80 of the cam device 65 when the connector 50 is in the expanded position of FIGS. 3A and 3B.

Figure 5:
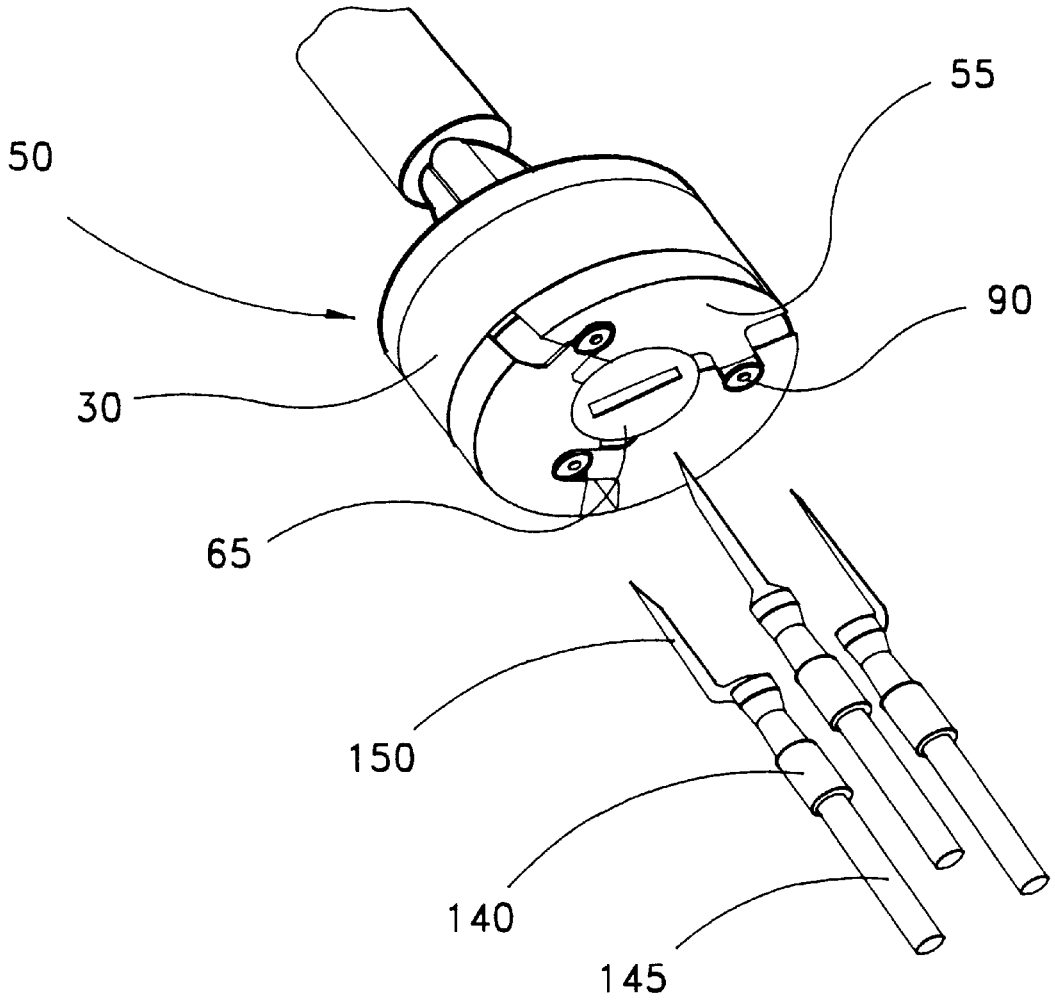
FIG. 5 is an isometric view of the connector of FIG. 4A interfacing with contact terminals.

FIG. 5 illustrates the connector 50 of FIGS. 3A, 3B, 4A, and 4B being interfaced with terminals 140. The terminals 140 include external contact members 145 for establishing an external electrical connection with the connector 50 and contact pins 150 for insertion into the wires 90. In the illustrated embodiment of FIG. 5, the contact pins 150 are formed by stamping, and thus have a flattened (i.e., rectangular) cross-section, as opposed to the circular contact pins 25 of FIG. 1.

Figure 6:
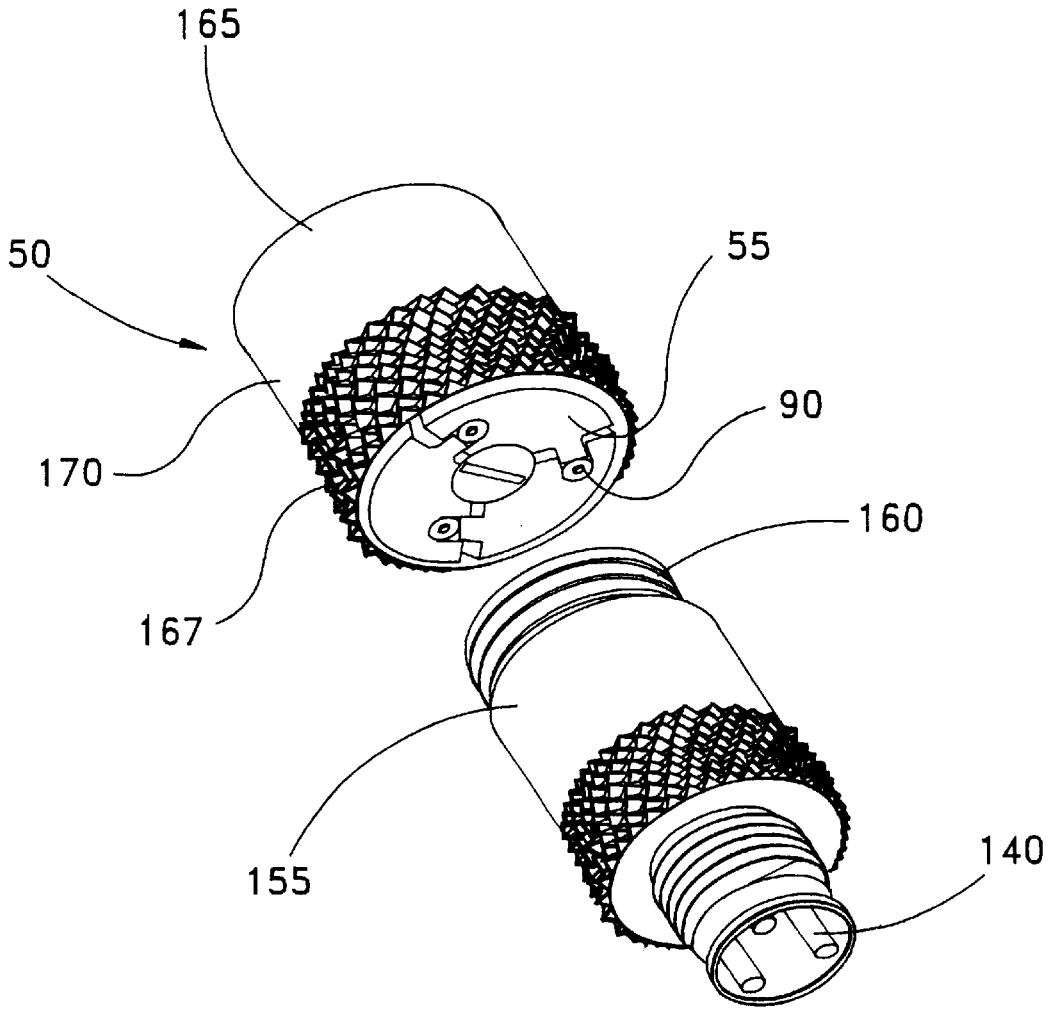
FIG. 6 is an isometric view of the connector of FIG. 5 including pin and spacer housings.

FIG. 6 illustrates the connector of FIG. 5 including a pin housing 155 surrounding and retaining the terminals 140. The pin housing 155 includes a threaded end 160. A corresponding spacer housing 165 surrounds the spacers 55. The spacer housing 165 includes a rotating portion 167 and a stationary portion 170. The stationary portion 170 maintains the alignment of the connector 50 with respect to the terminals 140 contained in the pin housing 155. The rotating portion 167 includes threads (not shown) that engage the corresponding threaded end 160 of the pin housing 155 to provide mechanical advantage for inserting the contact pins 150 into the wires 90. As is well known in the art, an alignment key (not shown) may be defined in the stationary portion 170 to mate with a corresponding feature (not shown) on the pin housing 155, thereby maintaining their relative alignment.

Figure 7A:
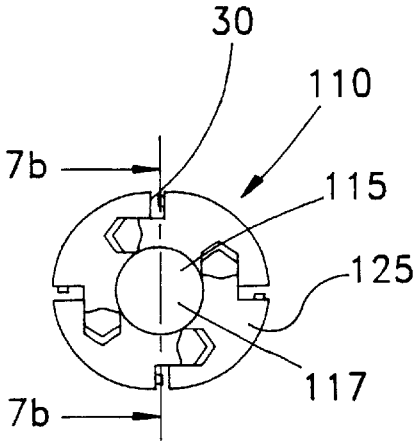
FIG. 7A is an end view of an alternative embodiment of an electrical connector in accordance with the present invention in an expanded position.
Figure 7B:
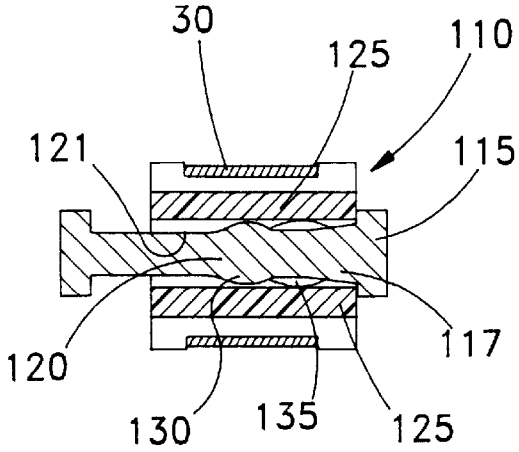
FIG. 7B is a cross-sectional view of the connector of FIG. 7A taken along line 7B—7B.

FIGS. 7A, 7B, 8A, and 8B illustrate another embodiment of an electrical connector 110 in accordance with the present invention. FIG. 7A illustrates an end view of the connector 110, and FIG. 7B illustrates a longitudinal cross-section taken along line 7B—7B in FIG. 7A. The connector 110 has an alternative cam device 115 as compared to the connector 50 of FIGS. 3A, 3B, 4A, and 4B. In addition, the connector 110 is adapted to receive four wires (not shown). The cam device 115 comprises a plunger 117 having an enlarged neck portion 120. The bore 121 defined between the spacers 125 has first and second enlarged diameter portions 130, 135 defined therein. The first enlarged diameter portion 130 has a diameter less than the diameter of the enlarged neck portion 120, and the second enlarged diameter portion 135 has a diameter slightly larger than the diameter of the enlarged neck portion 120. Lateral motion of the plunger 117 from the position where the enlarged neck portion 120 engages the second enlarged diameter portion 135 of the bore 121 to where the enlarged neck portion 120 engages the first enlarged diameter portion 130 urges the spacers 125 away from one another.

In FIGS. 7A and 7B the connector 110 is illustrated in the expanded position. The enlarged neck portion 120 of the plunger 117 contacts the first enlarged diameter portion 130, thus urging the spacers 125 outwardly against the compressive force provided by the compression member 30.

Figure 8A:
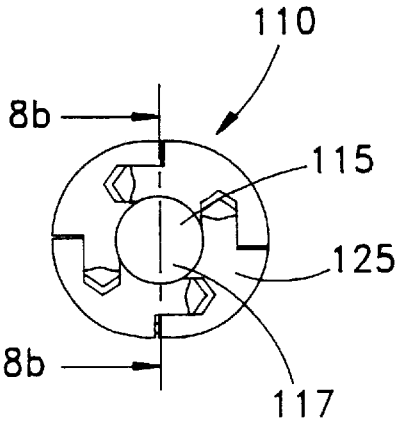
FIG. 8A is an end view of the connector of FIG. 7A in an engaged position.
Figure 8B:
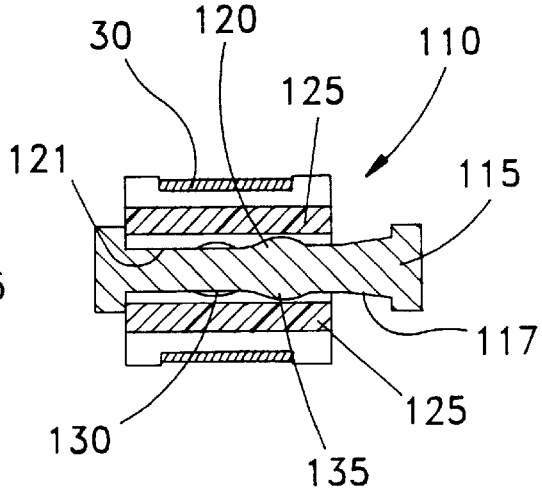
FIG. 8B is a cross-sectional view of the connector of FIG. 8A taken along line 8B—8B.

FIG. 8A illustrates an end view of the connector 110, and FIG. 8B illustrates a longitudinal cross-section taken along line 8B—BB in FIG. 8A. FIGS. 8A and 8B illustrate the connector 110 in the engaged position. The. enlarged neck portion 120 of the plunger 117 is contained within the second enlarged diameter portion 135, thus allowing the compressive force provided by the compression member 30 to seat the spacers 125. Again, the diameter of the bore 121 is larger than the diameter of the cam device 115 to prevent the cam device 115 from absorbing the compressive force applied to the spacers 125 by the compression member 30.

Figure 9:
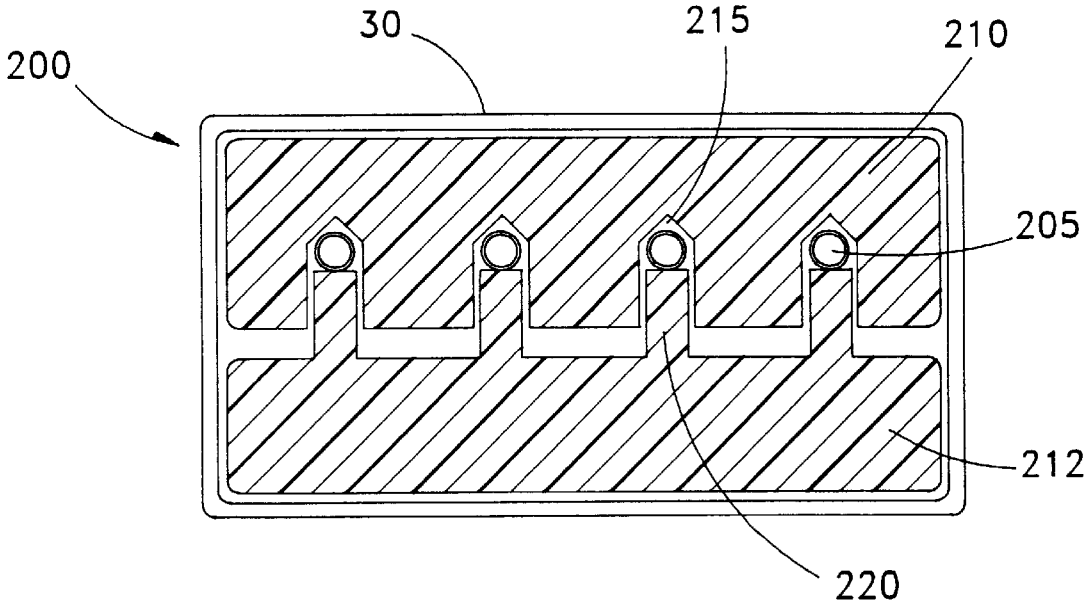
FIG. 9 is an end view of an alternative embodiment of an electrical connector in accordance with the present invention.

FIG. 9 illustrates an alternative embodiment of an electrical connector 200 in accordance with the present invention. The connector 200 has a rectangular cross-section, and the wires 205 are in row alignment. In the illustrated embodiment, a spacer 210 may include a plurality of channels 215, and another spacer 212 may include a plurality of tabs 220. Other configurations of the spacers 210, 212 and the tabs 220 and channels 215 are contemplated. The contact pins (not shown) may be retained in a corresponding rectangular pin housing (not shown) for axial insertion into the wires 205.

Figure 10:
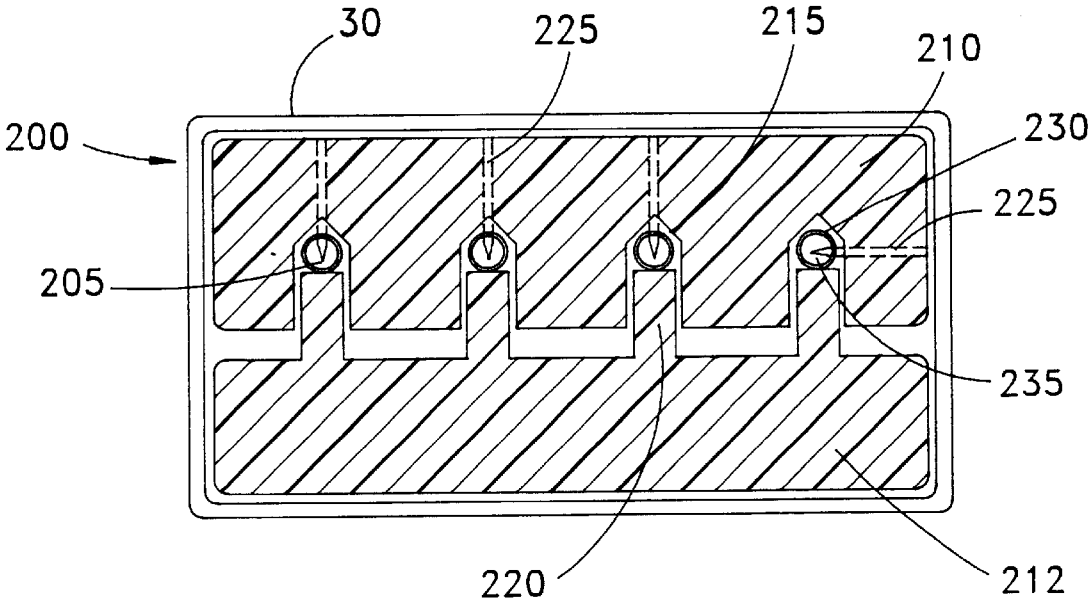
FIG. 10 is an end view of the connector of FIG. 9 interfacing with transversely intersecting contact pins.

FIG. 10 illustrates the electrical connector 200 of FIG. 9, however, instead of the contact pins 225 being inserted axially into the wires 205, the contact pins 225 are inserted transversely into the wires 205. The contact pins 225 pierce the insulation 230 of the wires 205 and contact the conductor core 235 (e.g., wire strands). The connector 200 may still be re-used without reconditioning the wires 205, because the insulation 230 is pierced, not cut as is the case with an insulation displacement connector. The contact pins 225 may extend only partially into the conductor core 235, or alternatively, the contact pins 225 may extend entirely through the conductor core 235 and/or insulation 230. The transverse insertion of the contact pins 225 may be used with any number of wires 205 or connector 200 shape. For instance, transverse connections to a circular connector (not shown) are also contemplated. A pin housing (not shown) would align the contact pins 225 for insertion depending on the specific geometry of the connector 200.

Figure 11:
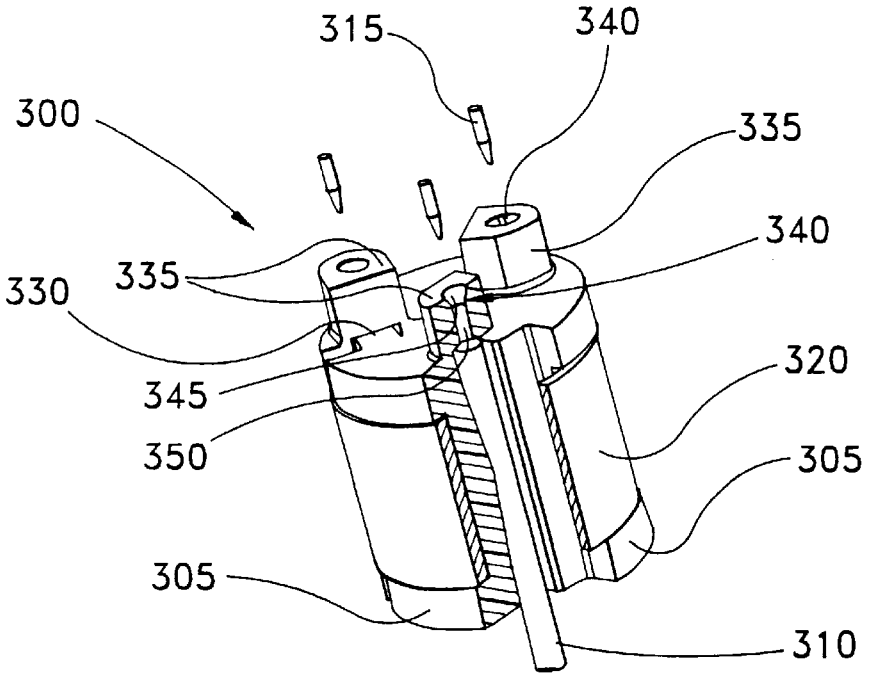
FIG. 11 is an isometric view of an alternative embodiment of an electrical connector in accordance with the present invention.
Figure 12:
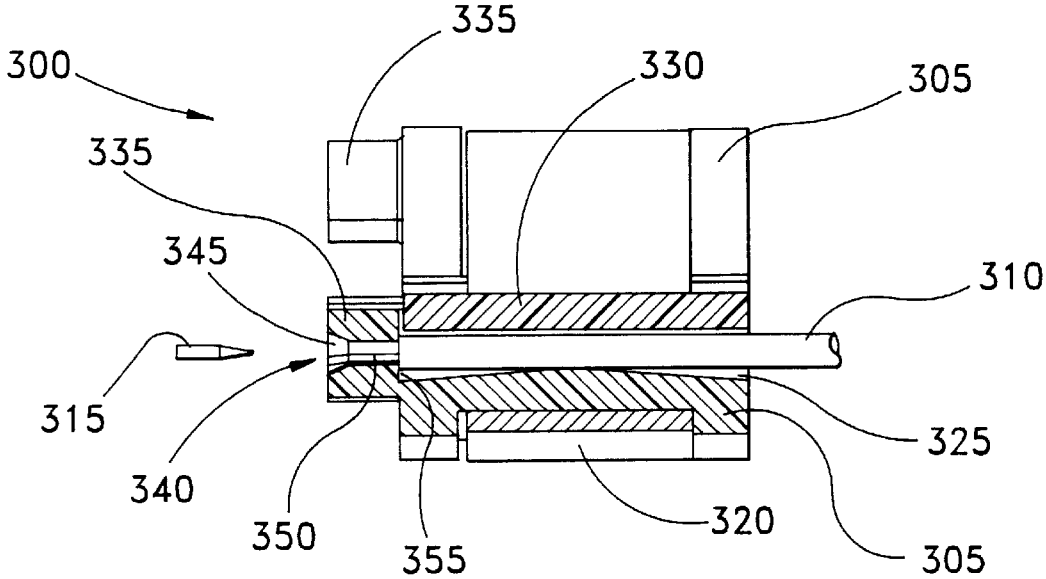
FIG. 12 is a cross-sectional view of the electrical connector of FIG. 11.

Turning now to FIG. 11, an isometric view of an alternative embodiment of an electrical connector 300 is provided. The connector 300 includes a plurality of spacers 305 for retaining and separating the wires 310. Contact pins 315 are provided for establishing an electrical connection with the wires 310. Note that only the tip portions of contact pins 315 are illustrated. A compression member 320 provides compressive force on the spacers 305 to maintain the alignment of the wires 310. FIG. 12 illustrates a cross-sectional view of the connector 300 of FIG. 11.

Referring to FIGS. 11 and 12, each spacer 305 includes a channel 325 (shown in FIG. 12) and a tab 330 defined therein. The tab 330 of one spacer 305 cooperates with the channel 325 of an adjacent spacer 305 to retain the wire 310 in the channel 325. The compression member 320 provides a compressive force that forces the tab 330 into the channel 325. Each spacer 305 further includes an alignment flange 335 defined proximate the channel 325. The alignment flange 335 includes an alignment channel 340 formed therein. The alignment channel 340 includes a frustoconical end portion 345 and a cylindrical portion 350. The frustoconical end portion 345 receives the contact pin 315 as it is being inserted into the connector 300. The frustoconical shape helps to guide the contact pin 315 into the cylindrical portion 350, even if the contact pin 315 is slightly misaligned. The cylindrical portion 350 communicates with the channel 325 proximate the wire 310.

In the illustrated embodiment, the cylindrical portion 350 of the alignment channel 340 has a smaller diameter than the channel 325 and the wire 310. As the wire 310 is inserted into the channel 325, it contacts the rear wall 355 of the alignment flange 335, preventing further insertion. The wire 310 is thus positioned in a known position and aligned with the alignment channel 340, such that when the contact pin 315 is inserted through the alignment channel 340, it contacts the wire 310 in a known position. The alignment channel 340 compensates for minor contact pin 315 misalignments and increases the reliability and repeatability of the contact pin 315 insertion process. It is contemplated that the alignment channel 340 feature may be incorporated with any of the embodiments described herein.

Figure 13:
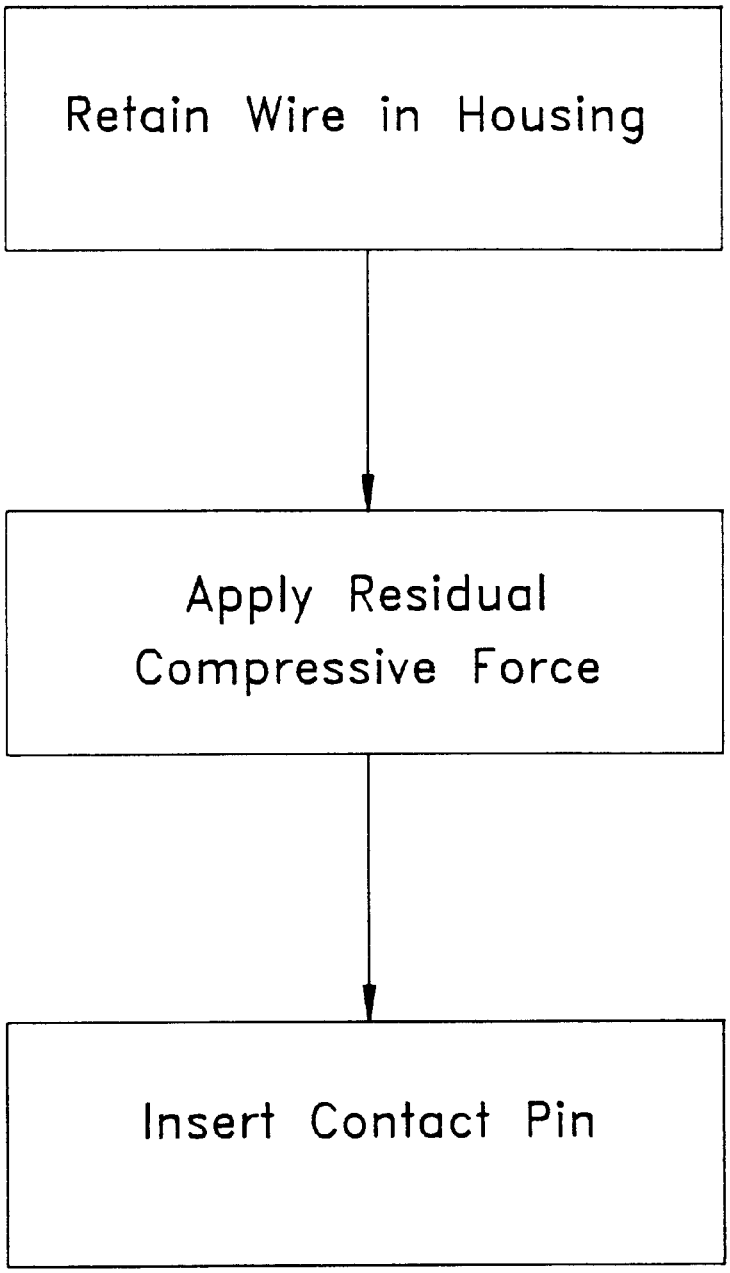
FIG. 13 is a flow chart of a method for establishing an electrical connection with a wire in accordance with the present invention.

As can be readily appreciated by one of ordinary skill in the art given the benefit of this disclosure, any cross-section or wire geometry may be used to develop a connector in accordance with the present invention. FIG. 13 illustrates a flow chart of a method for establishing an electrical connection with a wire in accordance with the present invention. The wire is retained in a connector housing. Residual compressive force is applied to the wire. A contact pin is inserted into the wire. The residual compressive force helps maintain the electrical connection between the wire and the contact pin.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A connector for establishing an electrical connection with a wire, the connector comprising:

a plurality of spacers, each spacer including a channel and a tab, the tab of each spacer aligned with and configured for insertion into the channel of an adjacent spacer;

a bore defined by the plurality of spacers; and a cam device located in the bore, wherein the cam device is rotatable within the bore and engages each of the plurality of spacers upon rotation to force the plurality of spacers away from one another.

2. The connector of claim 1, further comprising a compression member encompassing the plurality of spacers and configured for urging the tab of each spacer into the channel of the adjacent spacer.

3. The connector of claim 1, further comprising a contact pin, at least a portion of the contact pin insertable into the wire.

4. The connector of claim 1, wherein at least two of the plurality of spacers are substantially identical.

5. The connector of claim 1, wherein the bore has a polygonal cross-section including at least one face, the cam device has a polygonal cross-section having at least one corner and the corner of the cam device contacts the face of the bore to force the plurality of spacers away from one another.

6. The connector of claim 1, wherein the bore has a first enlarged diameter portion, the cam device has an enlarged neck portion having a diameter greater than the diameter of the first enlarged diameter portion of the bore and the enlarged neck contacts the first enlarged diameter portion of the bore to force the plurality of spacers away from one another.

7. An electrical connector for interconnecting at least two wires with at least two electrical contacts, comprising:

a plurality of substantially identical spacers, each spacer including a channel for receiving a wire and a tab configured for insertion into the channel of an adjacent spacer for retaining the wire in the channel; and at least two contact pins, at least a portion of each contact pin being insertable into each of the at least two wires.

8. An electrical connector as set forth in claim 7, wherein each of the contact pins is inserted into the corresponding wire in an axial direction.

9. An electrical connector as set forth in claim 7, wherein the plurality of spacers form a retention device having a circular cross-section.

10. An electrical connector as set forth in claim 7, wherein the plurality of spacers form a retention device having a rectangular cross-section.

11. An electrical connector as set forth in claim 7, further comprising a bore defined by the plurality of spacers and a cam device located in the bore.

12. An electrical connector as set forth in claim 11, wherein the cam moves the plurality of spacers between a wire engaging relationship and a wire receiving relationship.

13. An electrical connector as set forth in claim 12, wherein a portion of the bore has a first diameter and a portion of the cam has a second diameter, the first diameter being less than the second diameter such that when the cam portion is aligned with the bore portion the spacers move to the wire receiving relationship.

14. An electrical connector as set forth in claim 12, wherein the bore has a polygonal cross-section including at least one face, the cam device has a polygonal cross-section having at least one corner wherein the at least one corner of the cam device engages the at least one face of the bore to move the spacers into the wire receiving relationship.

15. An electrical connector as set forth in claim 7, wherein each channel includes at least one raised portion therein.

16. An electrical connector as set forth in claim 15, wherein the raised portion is located near a center of the channel.

17. An electrical connector as set forth in claim 7, further comprising a compression member encompassing the plurality of spacers and configured for urging the tab of each spacer into the channel of the adjacent spacer.

18. An electrical connector as set forth in claim 17, wherein the compression member comprises an elastic sleeve surrounding at least a majority of the plurality of spacers.

19. An electrical connector as set forth in claim 7, further comprising a pin housing, wherein the at least one contact pin is fixedly retained in the pin housing and a spacer housing, wherein the plurality of spacers are retained in the spacer housing.

20. An electrical connector as set forth in claim 19, wherein the spacer housing comprises a rotating portion engageable with the pin housing and a stationary portion fixedly engaged with the retention member.

21. An electrical connector as set forth in claim 20, wherein the pin housing includes a first threaded surface, and the rotating portion of the spacer housing includes a second threaded surface, the first and second threaded surfaces cooperating to engage the pin housing and the spacer housing.

22. A connector for establishing an electrical connection with a plurality of wires, the connector comprising:

at least; three spacers, each spacer including a channel and a tab, the channel for receiving one of the plurality of wires, the tab of each spacer aligned with and configured for insertion into the channel of an adjacent spacer for retaining the wire in the channel, wherein the number of spacers equals the number of wires associated with the connector.

23. An electrical connector as set forth in claim 22, further comprising a compression member encompassing the plurality of spacers and configured for urging the tab of each spacer into the channel of the adjacent spacer.

24. An electrical connector as set forth in claim 22, further comprising a bore defined by the plurality of spacers and a cam device located in the bore.

25. An electrical connector as set forth in claim 24, wherein the cam moves the plurality of spacers between a wire engaging relationship and a wire receiving relationship.

26. An electrical connector as set forth in claim 24, wherein a portion of the bore has a first diameter and a portion of the cam has a second diameter, the first diameter being less than the second diameter such that when the cam portion is aligned with the bore portion the spacers move to the wire receiving relationship.

27. An electrical connector as set forth in claim 24, wherein the bore has a polygonal cross-section including at least one face, the cam device has a polygonal cross-section having at least one corner wherein the at least one corner of the cam device engages the at least one face of the bore to move the spacers into the wire receiving relationship.

* * * * *